US007367836B2

(12) United States Patent
Wong et al.

(10) Patent No.: US 7,367,836 B2
(45) Date of Patent: May 6, 2008

(54) RTM ALIGNMENT AND KEYING MECHANISM

(75) Inventors: Henry Wong, Tempe, AZ (US); Suzanne M. Wong, Tempe, AZ (US)

(73) Assignee: Emerson Network Power-Embedded Computing, Inc., Madison, WI (US)

( * ) Notice: Subject to any disclaimer, the term of this patent is extended or adjusted under 35 U.S.C. 154(b) by 285 days.

(21) Appl. No.: 10/889,804

(22) Filed: Jul. 13, 2004

(65) Prior Publication Data

US 2006/0014415 A1 Jan. 19, 2006

(51) Int. Cl.
*H01R 13/64* (2006.01)

(52) U.S. Cl. ..... 439/378

(58) Field of Classification Search ..... 439/377–379, 439/64, 680–681, 347, 488–490, 625–626, 439/660, 677; 709/250; 714/1, 609; 361/788, 361/796, 798, 752–753, 791, 685; 710/2, 710/300–301

See application file for complete search history.

(56) References Cited

U.S. PATENT DOCUMENTS

| | | | | |
|---|---|---|---|---|
| 5,480,319 | A * | 1/1996 | Vlakancic | 439/347 |
| 6,371,790 | B1 * | 4/2002 | Huang | 439/378 |
| 6,767,238 | B2 * | 7/2004 | Kitadai | 439/378 |
| 6,912,595 | B2 * | 6/2005 | Deikman et al. | 709/250 |
| 6,945,810 | B1 * | 9/2005 | Morana et al. | 439/378 |

* cited by examiner

*Primary Examiner*—Edwin A. Leon
(74) *Attorney, Agent, or Firm*—Harness, Dickey & Pierce P.L.C.

(57) ABSTRACT

A rear transition module (220) includes a connector (230) in an RP0 mechanical envelope (242), and an RTM alignment and keying mechanism (232) in the RP0 mechanical envelope of the rear transition module that uniquely corresponds to a first signal path configuration (363) in a corresponding connector (234) on a backplane (202) of a VXS multi-service platform system chassis (103), where the rear transition module is coupled to operate within the VXS multi-service platform system chassis having a VMEbus network (108) and a switched fabric (110) coincident on the backplane.

14 Claims, 3 Drawing Sheets

100

RTM ALIGNMENT AND KEYING MECHANISM

BACKGROUND OF THE INVENTION

In current embedded computer platforms, such as VERSAmodule Eurocard (VMEbus) systems, the shared multi-drop bus can only be used to support one simultaneous communication between modules in the network. However, some applications have requirements for simultaneous high bandwidth transfers between modules in the VMEbus system that cannot be handled by the shared multi-drop architecture of VMEbus. It is desirable to configure current VMEbus systems to accommodate high-speed data transfers while maintaining the existing VMEbus network architecture. Since numerous high-speed data standards are available, it is also desirable to ensure that rear transition boards designed for interfacing with one type of payload board are not improperly interfaced with a backplane and an incompatible payload board.

Accordingly, there is a significant need for an apparatus and method that overcomes the deficiencies of the prior art outlined above.

BRIEF DESCRIPTION OF THE DRAWINGS

Referring to the drawing.

Figure 1:
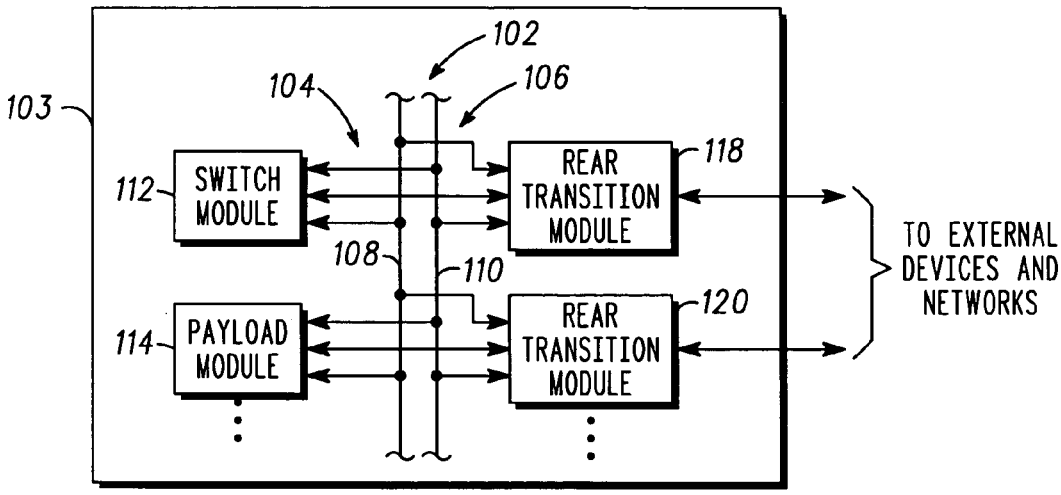
FIG. 1 depicts a VXS multi-service platform system according to one embodiment of the invention.

It will be appreciated that for simplicity and clarity of illustration, elements shown in the drawing have not necessarily been drawn to scale. For example, the dimensions of some of the elements are exaggerated relative to each other. Further, where considered appropriate, reference numerals have been repeated among the Figures to indicate corresponding elements.

DESCRIPTION OF THE PREFERRED EMBODIMENTS

In the following detailed description of exemplary embodiments of the invention, reference is made to the accompanying drawings, which illustrate specific exemplary embodiments in which the invention may be practiced. These embodiments are described in sufficient detail to enable those skilled in the art to practice the invention, but other embodiments may be utilized and logical, mechanical, electrical and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known circuits, structures and techniques have not been shown in detail in order not to obscure the invention.

For clarity of explanation, the embodiments of the present invention are presented, in part, as comprising individual functional blocks. The functions represented by these blocks may be provided through the use of either shared or dedicated hardware, including, but not limited to, hardware capable of executing software. The present invention is not limited to implementation by any particular set of elements, and the description herein is merely representational of one embodiment.

FIG. 1 depicts a VMEbus Switched Serial (VXS) multi-service platform system 100 according to one embodiment of the invention. A VXS multi-service platform system 100 can include one or more computer chassis, with software and any number of slots for inserting payload modules 114 and rear transition modules 118, 120. Modules can add functionality to VXS multi-service platform system 100 through the addition of processors, memory, storage devices, device interfaces, network interfaces, and the like. In one embodiment a backplane connector is used for connecting modules placed in the slots. In an embodiment, VXS multi-service platform system 100 comprises an embedded-type computer system having a chassis supporting a backplane and further comprising individual slots. In an embodiment, slots on the front portion 104 of the backplane 102 are coupled for receiving switch modules 112 and payload modules 114 that plug into the backplane 102. In an embodiment, slots on the rear portion 106 of the backplane 102 are coupled for receiving rear transition modules 118, 120 that also plug into the backplane 102. In an embodiment, each payload module and rear transition module can have a standardized form factor including physical dimensions, electrical connections, and the like as specified in an industry standard specification, for example VERSAmodule Eurocard (VMEbus), VXS, and the like, as described further below.

As an example of an embodiment, VXS multi-service platform system 100 can include VXS multi-service platform chassis 103 and one or more modules conforming to the VERSAmodule Eurocard (VMEbus) switched serial standard backplane (VXS) as set forth in VITA 41 promulgated by VMEbus International Trade Association (VITA), P.O. Box 19658, Fountain Hills, Ariz., 85269. VXS multi-service platform system 100 includes a packet switched network, known as a switched fabric 110 and a VMEbus network, both located on backplane 102. In other words, a VXS multi-service platform system 100 includes switched fabric 110 coincident with VMEbus network 108 on backplane 102.

In an embodiment, VXS multi-service platform system 100 can be controlled by a platform controller (not shown for clarity), which can include a processor for processing algorithms stored in memory. Memory comprises control algorithms, and can include, but is not limited to, random access memory (RAM), read only memory (ROM), flash memory, electrically erasable programmable ROM (EEPROM), and the like. Memory can contain stored instructions, tables, data, and the like, to be utilized by processor. Platform controller can be contained in one, or distributed among two or more payload modules with communication among the various modules of VXS multi-service platform system 100.

Switched fabric 110 operating on backplane 102 can use a switch module 112 as a central switching hub with any number of payload modules 114 coupled to switch module 112. Switched fabric 110 can be based on a point-to-point, switched input/output (I/O) fabric, whereby cascaded switch devices interconnect end node devices. Switched fabric 110 can include both module-to-module (for example computer systems that support I/O module add-in slots) and chassis-to-chassis environments (for example interconnecting computers, external storage systems, external Local Area Network (LAN) and Wide Area Network (WAN) access devices in a data-center environment). Backplane 102 can be implemented by using one or more of a plurality of switched fabric standards, for example and without limitation, InfiniBand™, Serial RapidIO™, FibreChannel™, Ethernet™, PCI Express™, Universal Serial Bus (USB), Serial AT Attachment (Serial ATA), Serial Attached Small Computer System Interface (Serial Attached SCSI), and the like. Backplane 102 is not limited to the use of these switched fabric standards and the use of any switched fabric standard is within the scope of the invention.

VMEbus network 108 is a parallel multi-drop bus network that is known in the art. VMEbus network 108 is defined in the ANSI/VITA 1-1994 and ANSI/VITA 1.1-1997 standards, promulgated by the VMEbus International Trade Association (VITA), P.O. Box 19658, Fountain Hills, Ariz., 85269 (where ANSI stands for American National Standards Institute). In an embodiment of the invention, VMEbus network 108 can include VMEbus based protocols such as Single Cycle Transfer protocol (SCT), Block Transfer protocol (BLT), Multiplexed Block Transfer protocol (MBLT), Two Edge VMEbus protocol (2eVME) and Two Edge Source Synchronous Transfer protocol (2eSST). VMEbus network 108 is not limited to the use of these VMEbus based protocols and other VMEbus based protocols are within the scope of the invention.

In an embodiment of the invention, VMEbus network 108 and switched fabric 110 operate concurrently within VXS multi-service platform system 100. In one embodiment, switched fabric 110 operates in parallel with VMEbus network 108 in a VXS multi-service platform system 100.

In an embodiment, payload modules 114 and rear transition modules 118, 120 can have a physical form factor including physical dimensions, electrical connections, and the like as set forth in the ANSI/VITA 1-1994 and ANSI/VITA 1.1-1997 standards.

In an embodiment, rear transition modules 118, 120 can be used to interface VXS multi-service platform system chassis 103 to external devices and networks. For example, rear transition modules 118, 120 can be used to interface VXS multi-service platform system chassis 103 to other chassis, other networks such as Ethernet, the Internet, and the like. Also, rear transition modules 118, 120 can be used to interface VXS multi-service platform system 100 with devices such as storage drives, memory, processors, and the like.

In an embodiment, each rear transition module can have a corresponding payload module or corresponding switch module. For example, rear transition module 120 has corresponding payload module 114. Also, rear transition module 118 has corresponding switch module 112. In an embodiment, within VXS multi-service platform system chassis 103 rear transition module is substantially coplanar to its corresponding payload module or corresponding switch module. This can mean that rear transition module coupled to rear portion 106 of backplane 102 is substantially in the same plane as its corresponding payload module or corresponding switch module coupled to the front portion 104 of backplane 102.

In an embodiment, rear transition module 120 can be coupled directly to switched fabric 110 and/or VMEbus network 108. Also, rear transition module 120 can also be coupled to corresponding payload module 114 through backplane 102. In the embodiment shown, rear transition module 120 is shown coupled to VMEbus network 108, switched fabric 110 and payload module 114. This is not limiting of the invention as rear transition module 120 can be coupled to any combination of VMEbus network 108, switched fabric 110 and payload module 114 and be within the scope of the invention.

In another embodiment, rear transition module 118 is coupled to corresponding switch module 112 through backplane 102. Rear transition module 118 can also be coupled to VMEbus network 108 and/or switched fabric 110. In the embodiment shown, rear transition module 118 is shown coupled to VMEbus network 108, switched fabric 110 and switch module 112. This is not limiting of the invention as rear transition module 118 can be coupled to any combination of VMEbus network 108, switched fabric 110 and switch module 112 and be within the scope of the invention.

Figure 2:
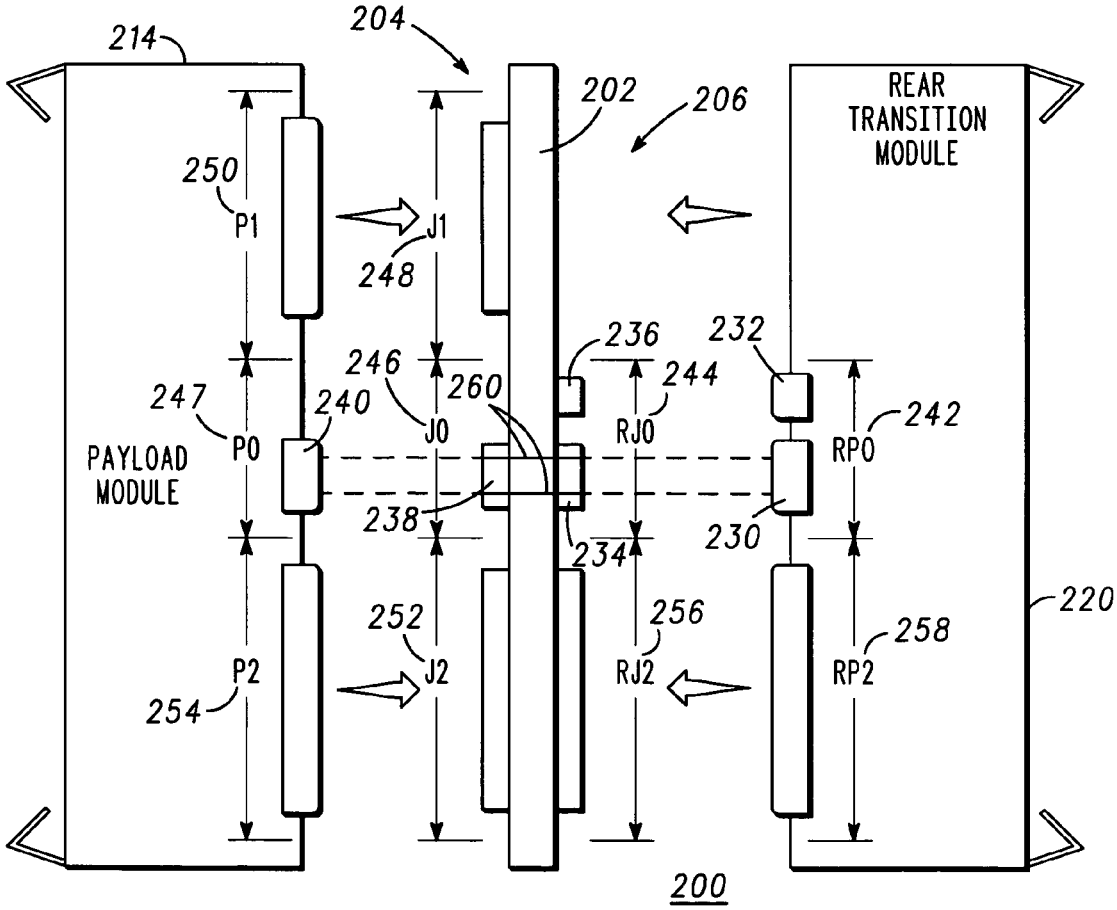
FIG. 2 depicts a VXS multi-service platform system according to an embodiment of the invention.

FIG. 2 depicts a VXS multi-service platform system 200 according to an embodiment of the invention. In an embodiment of the invention, backplane 202 and payload module 214 have a set of interlocking connectors designed to interlock with each other when payload module 214 is placed in a slot of VXS multi-service platform system 200. Payload module 214 is coupled to interface with front portion 204 of backplane 202. Mechanical and electrical specifications for a portion of these interlocking connectors can be found in the ANSI/VITA 1-1994 and ANSI/VITA 1.1-1997 and the VITA 41 standards cited above for VMEbus systems. For example, these standards define P0 mechanical envelope 247, P1 mechanical envelope 250, and P2 mechanical envelope 254 on payload module 214. These standards further define corresponding J0 mechanical envelope 246, J1 mechanical envelope 248, and J2 mechanical envelope 252 on backplane 202. Connectors in the P0/J0, P1/J1 and P2/J2 mechanical envelopes can interlock when payload module 214 is placed in a slot of VXS multi-service platform system 200.

In an embodiment, payload module 214 has one portion of an interlocking connector in the P1 mechanical envelope 250 designed to interlock with its corresponding portion located in the J1 mechanical envelope 248 on backplane 202. Also, payload module 214 can have an interlocking connector in the P2 mechanical envelope 254 designed to interlock with its corresponding portion located in the J2 mechanical envelope 252 on the backplane 202.

In an embodiment of the invention, connectors in the P1/J1 and P2/J2 mechanical envelopes are for coupling VMEbus network 108 to payload module 214, while the connector in P0/J0 mechanical envelope is for coupling switched fabric 110 to payload module 214. When payload module 214 is placed in a slot and coupled to backplane 202 via connectors in the P1/J1 and P2/J2 mechanical envelopes, the functionality of payload module 214 is added to VXS multi-service platform system 200 via VMEbus network 108. For example, processors, memory, storage devices, I/O elements, and the like, on payload module 214 are accessible by other payload modules in VXS multi-service platform system 200 and visa versa. When payload module 214 is placed in a slot and coupled to backplane 202 via a connector in the P0/J0 mechanical envelopes, the functionality of payload module 214 is added to VXS multi-service platform system 200 via switched fabric 110.

In this embodiment, payload module 214 can have payload module connector 240 in the P0 mechanical envelope 247 as defined in the VXS specification specified above. Backplane 202 can include payload connector 238 in the J0 mechanical envelope 246, where the payload module connector 240 and the payload connector 238 are designed to interface and interlock when payload module 214 is inserted into VXS multi-service platform system 200. In an embodiment, payload module connector 240 and payload connector 238 can be electrical, optical, radio frequency, biological, and the like, type connectors. In an embodiment, payload module connector 240 and payload connector 238 are designed for use in high-speed switched fabrics and are compatible with any of a plurality of switched fabric standards discussed above. In an example of an embodiment of the invention, payload module connector 240 in the P0 mechanical envelope 247 and payload connector 238 in the J0 mechanical envelope 246 can be a Tyco MultiGig RT connector manufactured by the AMP division of Tyco Electronics, Harrisburg, Pa. The invention is not limited to the use of the Tyco RT connector, and any connector capable of handling data using any of the plurality of switched fabric network standards is encompassed within the invention.

In the embodiment depicted in FIG. 2, VXS multi-service platform system 200 can include rear transition module 220 coupled to interface with rear portion 206 of backplane 202. In an embodiment, rear transition module 220 is substantially coplanar with corresponding payload module 214.

In an embodiment of the invention, backplane 202 and rear transition module 220 have a set of interlocking connectors designed to interlock with each other when rear transition module 220 is placed in a slot of VXS multi-service platform system 200. Rear transition module 220 is coupled to interface with rear portion 206 of backplane 202. Mechanical and electrical specifications for a portion of these interlocking connectors can be found in the ANSI/VITA 1-1994 and ANSI/VITA 1.1-1997 and the VITA 41 standards cited above for VMEbus systems. For example, these standards define RP0 mechanical envelope 242, and RP2 mechanical envelope 258 on rear transition module 220. These standards further define corresponding RJ0 mechanical envelope 244, and RJ2 mechanical envelope 256 on backplane 202. Connectors in the RP0/RJ0 and RP2/RJ2 mechanical envelopes can interlock when rear transition module 220 is placed in a slot of rear portion 206 of backplane 202 of VXS multi-service platform system 200.

In an embodiment, rear transition module 220 can have an interlocking connector in the RP2 mechanical envelope 258 designed to interlock with its corresponding portion located in the RJ2 mechanical envelope 256 on the backplane 202. In an embodiment of the invention, connector in the RP2/RJ2 mechanical envelopes can be for coupling VMEbus network 108 to rear transition module 220 or for coupling corresponding payload module 214 to rear transition module 220.

When rear transition module 220 is placed in a slot and coupled to rear portion 206 of backplane 202 via connector in the P2/J2 mechanical envelope, the functionality of rear transition module 220 can be added to VXS multi-service platform system 200. This functionality can be added via directly connecting to VMEbus network 108 or by coupling to corresponding payload module 214. For example, I/O elements, and the like, on rear transition module 220 can be accessible by other payload modules in VXS multi-service platform system 200. These I/O elements can access external devices and networks, for example, external storage devices, and external networks such as the Internet, other chassis, and the like.

In another embodiment, the connector in RP0/RJ0 mechanical envelope can be for directly coupling switched fabric 110 to rear transition module 220 or for coupling corresponding payload module 214 to rear transition module 220. When rear transition module 220 is placed in a slot and coupled to rear portion 206 of backplane 202 via a connector in the RP0/RJ0 mechanical envelopes, the functionality of rear transition module 220 is added to VXS multi-service platform system 200. This functionality can be added via directly connecting to switched fabric 110 or by coupling to corresponding payload module 214. For example, I/O elements, and the like, on rear transition module 220 can be accessible by other payload modules in VXS multi-service platform system 200. These I/O elements can access external devices and networks, for example, external storage devices, and external networks such as the Internet, other chassis, and the like.

In this embodiment, rear transition module 220 can have connector 230 in the RP0 mechanical envelope 242. Rear portion 206 of backplane 202 can include corresponding connector 234 in the RJ0 mechanical envelope 244, where the connector 230 and the corresponding connector 234 are designed to interface and interlock when rear transition module 220 is inserted into VXS multi-service platform system 200. In an embodiment, connector 230 and corresponding connector 234 can be electrical, optical, radio frequency, biological, and the like, type connectors. In an embodiment, connector 230 and corresponding connector 234 are designed for use in high-speed switched fabrics and are compatible with any of a plurality of switched fabric standards discussed above. In an example of an embodiment of the invention, connector 230 in the RP0 mechanical envelope 242 and corresponding connector 234 in the RJ0 mechanical envelope 244 can be a Tyco MultiGig RT connector manufactured by the AMP division of Tyco Electronics, Harrisburg, Pa. The invention is not limited to the use of the Tyco RT connector, and any connector capable of handling data using any of the plurality of switched fabric network standards is encompassed within the invention.

In an embodiment, one or more active signal paths 260 communicatively couple corresponding connector 234 on rear portion 206 of backplane 202 with payload connector 238 on front portion 204 of backplane 202. In an embodiment, corresponding connector 234 is substantially coplanar with payload connector 238. Active signal paths 260 can be any number of signal paths that communicatively couple corresponding connector 234 to payload connector 238. For example, active signal paths 260 can include populated signal paths in corresponding connector 234 and payload connector 238. Active signal paths 260 permit communication between rear transition module 220 and corresponding payload module 214 when both modules are coupled to backplane 202.

In an embodiment of the invention, rear transition module 220 can include a rear transition module (RTM) alignment and keying mechanism 232 in the RP0 mechanical envelope 242 that uniquely corresponds to a first signal path configuration in corresponding connector 234. Also, backplane 202 can include a corresponding rear transition module (RTM) alignment and keying mechanism 236 in the RJ0 mechanical envelope 244 that uniquely corresponds to first signal path configuration in corresponding connector 234. In an embodiment, first signal path configuration can include any combination of active signal paths 260 that communicatively couple corresponding connector 234 to payload connector 238. First signal path configuration is described with more particularity with reference to FIG. 4 below.

RTM alignment and keying mechanism 232 and corresponding RTM alignment and keying mechanism 236 are coupled to interconnect when both correspond to the first signal path configuration in corresponding connector 234. In other words, RTM alignment and keying mechanism 232 and corresponding RTM alignment and keying mechanism 236 interconnect only when both correspond to first signal path configuration. In addition, connector 230 and corresponding connector 234 interconnect only when RTM alignment and keying mechanism 232 and corresponding RTM alignment and keying mechanism 236 both correspond to the first signal path configuration. In other words, connector 230 and corresponding connector 234 interconnect only when RTM alignment and keying mechanism 232 and corresponding RTM alignment and keying mechanism 236 correspond to the same signal path configuration in corresponding connector 234 in RJ0 mechanical envelope 244.

Corresponding RTM alignment and keying mechanism 236 is designed to preclude coupling of an incompatible rear transition module to rear portion 206 of backplane 202. An incompatible rear transition module has RTM alignment and keying mechanism 232 that does not interface with corresponding RTM alignment and keying mechanism 236. This can occur, for example and without limitation, because RTM alignment and keying mechanism 232 and corresponding RTM alignment and keying mechanism 236 does not correspond to the same first signal path configuration in corresponding connector 234. In other words, if the active signal paths 260 present in corresponding connector 234 does not match the signal path configuration designated in RTM alignment and keying mechanism 232, the rear transition module 220 is incompatible and will not interface with backplane through the mating of connector 230 and corresponding connector 234.

Figure 3:
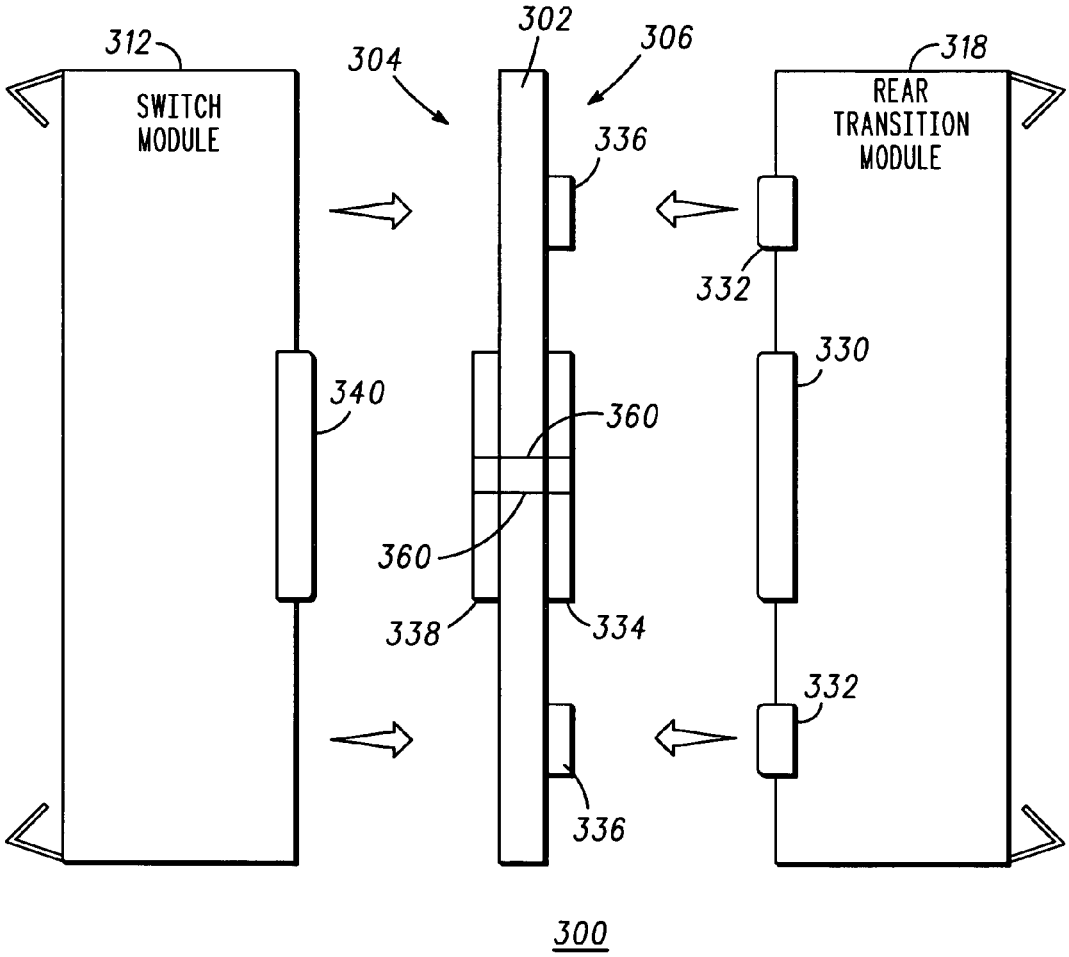
FIG. 3 depicts a VXS multi-service platform system according to another embodiment of the invention.

FIG. 3 depicts a VXS multi-service platform system according to another embodiment of the invention. In an embodiment of the invention, backplane 302 and switch module 312 have a set of interlocking connectors designed to interlock with each other when switch module 312 is placed in a slot of VXS multi-service platform system 300. Switch module 312 is coupled to interface with front portion 304 of backplane 302. Mechanical and electrical specifications for a portion of these interlocking connectors can be found in the ANSI/VITA 1-1994 and ANSI/VITA 1.1-1997 and the VITA 41 standards cited above for VMEbus systems.

Switch module 312 can have switch module connector 340 as defined in the VXS specification specified above. Backplane 302 can include backplane connector 338, where the switch module connector 340 and backplane connector 338 are designed to interface and interlock when switch module 312 is inserted into VXS multi-service platform system 300. In an embodiment, switch module connector 340 and backplane connector 338 can be electrical, optical, radio frequency, biological, and the like, type connectors. In an embodiment, switch module connector 340 and backplane connector 338 are designed for use in high-speed switched fabrics and are compatible with any of a plurality of switched fabric standards discussed above. In an example of an embodiment of the invention, switch module connector 340 and backplane connector 338 can be a Tyco MultiGig RT connector manufactured by the AMP division of Tyco Electronics, Harrisburg, Pa. The invention is not limited to the use of the Tyco RT connector, and any connector capable of handling data using any of the plurality of switched fabric network standards is encompassed within the invention.

In the embodiment depicted in FIG. 3, VXS multi-service platform system 300 can include rear transition module 318 coupled to interface with rear portion 306 of backplane 302. In an embodiment, rear transition module 318 is substantially coplanar with corresponding switch module 312.

In an embodiment of the invention, backplane 302 and rear transition module 318 have a set of interlocking connectors designed to interlock with each other when rear transition module 318 is placed in a slot of VXS multi-service platform system 300. Rear transition module 318 is coupled to interface with rear portion 306 of backplane 302. Mechanical and electrical specifications for a portion of these interlocking connectors can be found in the ANSI/VITA 1-1994 and ANSI/VITA 1.1-1997 and the VITA 41 standards cited above for VMEbus systems.

In an embodiment, rear transition module 318 can have connector 330. Rear portion 306 of backplane 302 can include corresponding connector 334, where the connector 330 and the corresponding connector 334 are designed to interface and interlock when rear transition module 318 is inserted into VXS multi-service platform system 300. In an embodiment, connector 330 and corresponding connector 334 can be electrical, optical, radio frequency, biological, and the like, type connectors. In an embodiment, connector 330 and corresponding connector 334 are designed for use in high-speed switched fabrics and are compatible with any of a plurality of switched fabric standards discussed above. In an example of an embodiment of the invention, connector 330 and corresponding connector 334 can be a Tyco MultiGig RT connector manufactured by the AMP division of Tyco Electronics, Harrisburg, Pa. The invention is not limited to the use of the Tyco RT connector, and any connector capable of handling data using any of the plurality of switched fabric network standards is encompassed within the invention.

In an embodiment, the connector 330 and corresponding connector 334 can be for directly coupling switched fabric 110 to rear transition module 318 or for coupling corresponding switch module 312 to rear transition module 318. When rear transition module 318 is placed in a slot and coupled to rear portion 306 of backplane 302, the functionality of rear transition module 318 is added to VXS multi-service platform system 300. This functionality can be added via directly connecting to switched fabric 110 or by coupling to corresponding switch module 312. For example, I/O elements, and the like, on rear transition module 318 can be accessible by other payload modules and/or switch module 312 in VXS multi-service platform system 300. These I/O elements can access external devices and networks, for example, external storage devices, and external networks such as the Internet, other chassis, and the like.

In an embodiment, one or more active signal paths 360 communicatively couple corresponding connector 334 on rear portion 306 of backplane 302 with backplane connector 338 on front portion 304 of backplane 302. In an embodiment, corresponding connector 334 is substantially coplanar with backplane connector 338. Active signal paths 360 can be any number of signal paths that communicatively couple corresponding connector 334 to backplane connector 338. For example, active signal paths 360 can include populated signal paths in corresponding connector 334 and backplane connector 338. Active signal paths 360 permit communication between rear transition module 318 and corresponding switch module 312 when both modules are coupled to backplane 302.

In an embodiment of the invention, rear transition module 318 can include one or more rear transition module (RTM) alignment and keying mechanisms 332 that uniquely corresponds to a first signal path configuration in corresponding connector 334. Also, backplane 302 can include one or more corresponding rear transition module (RTM) alignment and keying mechanisms 336 that uniquely corresponds to first signal path configuration in corresponding connector 334. In an embodiment, first signal path configuration can include any combination of active signal paths 360 that communicatively couple corresponding connector 334 to backplane connector 338. First signal path configuration is described with more particularity with reference to FIG. 4 below.

RTM alignment and keying mechanism 332 and corresponding RTM alignment and keying mechanism 336 are coupled to interconnect when both correspond to the first signal path configuration in corresponding connector 334. In other words, RTM alignment and keying mechanism 332 and corresponding RTM alignment and keying mechanism 336 interconnect only when both correspond to first signal path configuration. In addition, connector 330 and corresponding connector 334 interconnect only when RTM alignment and keying mechanism 332 and corresponding RTM alignment and keying mechanism 336 both correspond to the first signal path configuration. In other words, connector 330 and corresponding connector 334 interconnect only when RTM alignment and keying mechanism 332 and corresponding RTM alignment and keying mechanism 336 correspond to the same signal path configuration in corresponding connector 334.

Corresponding RTM alignment and keying mechanism 336 is designed to preclude coupling of an incompatible rear transition module to rear portion 306 of backplane 302. An incompatible rear transition module has RTM alignment and keying mechanism 332 that does not interface with corresponding RTM alignment and keying mechanism 336. This can occur, for example and without limitation, because RTM alignment and keying mechanism 332 and corresponding RTM alignment and keying mechanism 336 does not correspond to the same first signal path configuration in corresponding connector 334. In other words, if active signal paths 360 present in corresponding connector 334 does not match the signal path configuration designated in RTM alignment and keying mechanism 332, the rear transition module 318 is incompatible and will not interface with backplane through the mating of connector 330 and corresponding connector 334.

Figure 4:
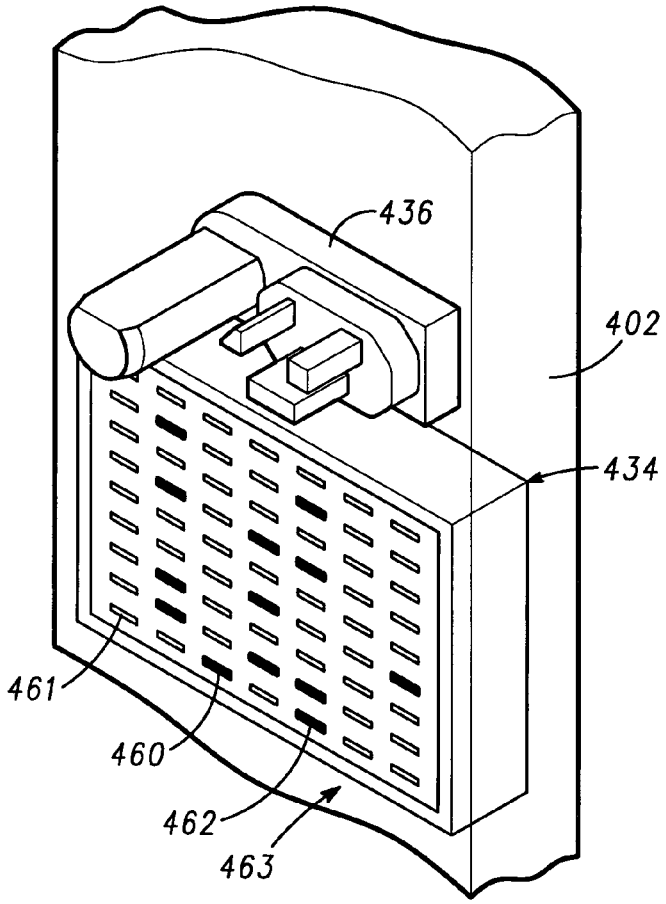
FIG. 4 depicts a backplane according to an embodiment of the invention.

FIG. 4 depicts a backplane 402 according to an embodiment of the invention. As shown in FIG. 4, backplane 402 includes corresponding connector 434 and corresponding RTM alignment and keying mechanism 436. Corresponding RTM alignment and keying mechanism is discussed in more detail with reference to FIG. 5 below.

In an embodiment, corresponding connector 434 is coupled to interlock with connector 230 of rear transition module 220 as discussed above. Corresponding connector 434 can include any number of connector pin sites 461. Connector pin sites 461 can include "chiclets," substantially round pins, square pins, and the like. The invention is not limited by the type or number of connector pin sites 461 in corresponding connector 434. Any type or number of connector pin sites 461 are within the scope of the invention.

Each connector pin site 461 can be either populated or unpopulated. If a connector pin site 461 is unpopulated, there is no signal path from corresponding connector 434 on rear portion 206 of backplane 202 to payload connector 238 on front portion 204 of backplane 202. In other words, an unpopulated connector pin site 461 does not communicatively couple rear transition module 220 to corresponding payload module 214, through a particular signal path as represented by a particular connector pin site 461.

In an embodiment, if a connector pin site is populated, it is an active signal path 460 through which rear transition module 220 and corresponding payload module 214 can be communicatively coupled. Set of active signal paths 462 comprises all of the active signal paths 462 present in corresponding connector 434. In an embodiment, set of active signal paths 462 can comprise any combination of one or more active signal paths 460 from corresponding connector 434 on rear portion 206 of backplane 202 to payload connector 238 on front portion 204 of backplane 202. In an embodiment, first signal path configuration 463 can be a particular combination of one or more active signal paths 462, and is not limited by the representative set of active signal paths shown in FIG. 4.

In another embodiment, FIG. 4 can represent corresponding connector 334, corresponding RTM alignment and keying mechanism 336 and active signal paths 360 as depicted in FIG. 3 above with reference to rear transition module 318 and switch module 312.

Figure 5:
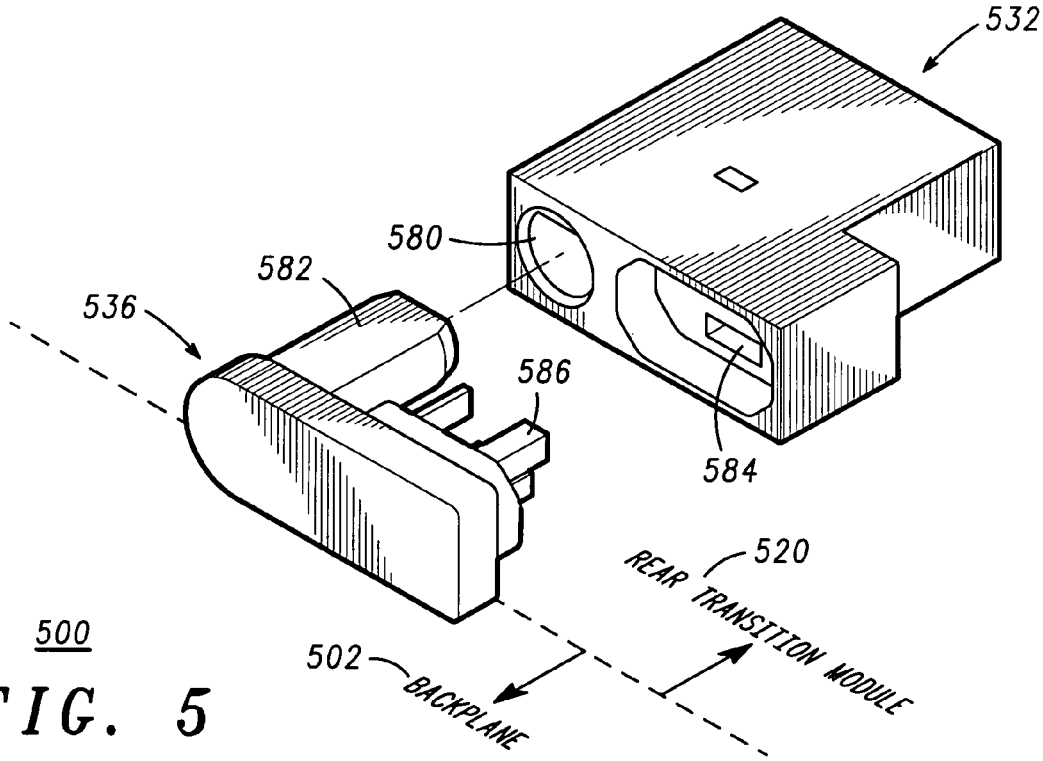
FIG. 5 depicts an isometric of RTM keying mechanisms according to an embodiment of the invention.

FIG. 5 depicts an isometric 500 of RTM keying mechanisms according to an embodiment of the invention. As shown in FIG. 5, RTM alignment and keying mechanism 532 can be located on rear transition module 520, and corresponding RTM alignment and keying mechanism 536 can be located on backplane 502. RTM alignment and keying mechanism 532 and corresponding RTM alignment and keying mechanism 536 ensure that any connectors located in the RP0 mechanical envelope 242 on rear transition module 520 cannot interconnect with incompatible connectors located in the RJ0 mechanical envelope 244 on backplane 502. Incompatibility can occur due to type of connector, position of connector within RP0 mechanical envelope 242 or RJ0 mechanical envelope 244, electrical incompatibility of connectors, and the like.

In an embodiment of the invention, RTM alignment and keying mechanism 532 and corresponding RTM alignment and keying mechanism 536 can have two features that must correspond to each other before connectors are allowed to interconnect. First, RTM alignment and keying mechanism 532 includes an alignment portion 580 uniquely corresponding to any of a first physical type of connector 230, a physical location of the RTM alignment and keying mechanism 532 and the corresponding RTM alignment and keying mechanism 536 in their respective mechanical envelopes, and the like. Also, corresponding RTM alignment and keying mechanism 536 includes corresponding alignment portion 582 uniquely corresponding to any of a first physical type of connector 230, a physical location of the RTM alignment and keying mechanism 532 and the corresponding RTM alignment and keying mechanism 536 in their respective mechanical envelopes, and the like.

First physical type of connector can include an electrical type of connector, optical type of connector, and the like. In an embodiment, alignment portion 580 and corresponding alignment portion 582 must both correspond to at least one of the same physical type of connector (i.e. electrical, optical, and the like), physical location of the RTM alignment and keying mechanism 532 and the corresponding RTM alignment and keying mechanism 536, within their respective mechanical envelopes in order to interface. This has the advantage of protecting both the rear transition module and the VXS multi-service platform system from having a rear transition module 520 that is not configured for a certain physical type of connector, from being inserted and connected to VXS multi-service platform system 100, 200.

As an example of an embodiment, corresponding alignment portion 582 can be substantially cylindrically shaped, with a portion of the curved cylindrical surface flattened. Depending on the amount of flattened surface and the angle of the flattened surface relative to the orientation of the backplane 502, corresponding alignment portion 582 can be uniquely disposed to correspond to one of a plurality of physical type of connectors, for example a first physical type of connector. As an example, the angle of flattened surface can be 0 degrees and correspond to an electrical type of connector of a VITA 41 standard rear transition module. Alignment portion 580 of RTM alignment and keying mechanism 532 can then be coupled to interface with corresponding alignment portion 582 by fashioning alignment portion 580 as a substantially cylindrically shaped receptacle with a flattened portion coupled to receive only a corresponding alignment portion 582, wherein both alignment portion 580 and corresponding alignment portion 582 both correspond a first physical type of connector. In another embodiment, corresponding alignment portion 582 can be substantially cylindrically shaped with no flattened surface. Also, alignment portion 580 can be a substantially cylindrically shaped receptacle coupled to receive corresponding alignment portion 582.

The second feature of RTM alignment and keying mechanism 532 includes a coding key portion 584 uniquely corresponding to first signal path configuration 463. Also, corresponding RTM alignment and keying mechanism 536 includes corresponding coding key portion 586 that uniquely corresponds to first signal path configuration 463. In an embodiment, coding key portion 584 and corresponding coding key portion 586 must both correspond to the same set of active signal paths 462 (i.e. first signal path configuration 463), in order to interface. This has the advantage of protecting both the rear transition module 520 and the multi-service platform system 100, 200 from having a rear transition module 520 that is not configured for a certain signal path configuration from being inserted and connected to VXS multi-service platform system 100, 200.

As an example of an embodiment, coding key portion 584 and corresponding coding key portion 586 can have any number of unique pins and receptacles designed to interface only when both coding key portion 584 and corresponding coding key portion 586 correspond to first signal path configuration 463. For example, coding key portion 584 and corresponding coding key portion 586 can have unique pin and receptacle positions and colors as defined by International Electrotechnical Commission (IEC) 61076-4-101. Coding key portion 584 and corresponding coding key portion 586 are not limited to IEC 61076-4-101, and any other key coding system is within the scope of the invention. As an example of an embodiment, first signal path configuration 463 can be associated with IEC 61076-4-101 1567 (Brilliant Blue Ral # 5007) and IEC 61076-4-101 2348 (Brilliant Blue Ral # 5007).

In an embodiment of the invention, alignment portion 580 and corresponding alignment portion 582 must successfully interface before coding key portion 584 and corresponding coding key portion 586 are allowed to interface. Also, coding key portion 584 and corresponding coding key portion 586 must successfully interface before connector 230 and corresponding connector 234 are allowed to interface. This has the advantage of minimizing any potential for interfacing a rear transition module having a configuration that is incompatible with VXS multi-service platform system 100 (i.e. incompatible physical types of connectors, and/or incompatible signal path configurations).

In another embodiment, the embodiment shown in FIG. 5 applies to the rear transition module 318 and switch module 312 embodiment, depicted in FIG. 3. In other words, RTM alignment and keying mechanism 332 and corresponding RTM alignment and keying mechanism 336 can have the features discussed above with reference to FIG. 5.

One advantage of an embodiment of the invention over the prior art is that RTM alignment and keying mechanism 532 and corresponding coding key portion 586 are field replaceable. This means that the coding key portion (and corresponding coding key portion) can be removed, upgraded, inserted, and the like without (1) having to remove an installed chassis from a rack or cabinet, or (2) remove the backplane from a chassis.

While we have shown and described specific embodiments of the present invention, further modifications and improvements will occur to those skilled in the art. It is therefore, to be understood that appended claims are intended to cover all such modifications and changes as fall within the true spirit and scope of the invention.

The invention claimed is:

1. A VMEbus Switched Serial (VXS) multi-service platform system, comprising:

a rear transition module (RTM) having a connector in a first mechanical envelope;

a rear portion of a backplane coupled to receive the rear transition module, wherein the rear portion of the backplane comprises a corresponding connector in a second mechanical envelope coupled to interface with the connector;

an RTM alignment and keying mechanism in the first mechanical envelope of the rear transition module that uniquely corresponds to a first signal path configuration in the corresponding connector wherein the first signal path is one of a plurality of available signal paths between the rear portion of the backplane and a front portion of the backplane; and a corresponding RTM alignment and keying mechanism in the second mechanical envelope of the rear portion of the backplane that uniquely corresponds to the first signal path configuration in the corresponding connector, and wherein the RTM alignment and keying mechanism and the corresponding RTM alignment and keying mechanism interconnect only when the RTM alignment and keying mechanism and the corresponding RTM alignment and keying mechanism both correspond to the first signal path configuration.

2. The VXS multi-service platform system of claim 1, wherein the connector and the corresponding connector interconnect only when the RTM alignment and keying mechanism and the corresponding RTM alignment and keying mechanism both correspond to the first signal path configuration.

3. The VXS multi-service platform system of claim 1, wherein the corresponding RTM alignment and keying mechanism precludes coupling of an incompatible rear transition module to the rear portion of the backplane.

4. The VXS multi-service platform system of claim 3, wherein the incompatible rear transition module has the RTM alignment and keying mechanism, and wherein the RTM alignment and keying mechanism does not correspond to the first signal path configuration.

5. The VXS multi-service platform system of claim 1, wherein the first signal path configuration comprises a set of active signal paths from the rear transition module to one of a corresponding payload module and a corresponding switch module coupled to the front portion of the backplane.

6. The VXS multi-service platform system of claim 1, wherein the first signal path configuration comprises a set of active signal paths in the corresponding connector that communicatively couple the corresponding connector in the rear portion of the backplane to a payload connector in a third mechanical envelope of a front portion of the backplane, wherein the corresponding connector is substantially coplanar with the payload connector.

7. The VXS multi-service platform system of claim 1, wherein the RTM alignment and keying mechanism comprises an alignment portion uniquely corresponding to a first physical type of connector and a coding key portion uniquely corresponding to the first signal path configuration, and wherein the corresponding RTM alignment and keying mechanism comprises a corresponding alignment portion uniquely corresponding to the first physical type of connector and a corresponding coding key portion uniquely corresponding to the first signal path configuration.

8. The VXS multi-service platform system of claim 7, wherein the connector and the corresponding connector interconnect only when:

the alignment portion and the corresponding alignment portion both correspond to the first physical type of connector; and the coding key portion and the corresponding coding key portion both correspond to the first signal path configuration.

9. A VMEbus Switched Serial (VXS) multi-service platform system chassis, comprising:

a backplane having a rear portion coupled to receive a rear transition module (RTM), wherein the rear transition module has a connector in a first mechanical envelope and an RTM alignment and keying mechanism in the first mechanical envelope;

a corresponding connector in a second mechanical envelope of the backplane coupled to interface with the connector, and wherein the RTM alignment and keying mechanism uniquely corresponds to a first signal path configuration in the corresponding connector wherein the first signal path is one of a plurality of available signal paths between the rear portion of the backplane and a front portion of the backplane; and a corresponding RTM alignment and keying mechanism in the second mechanical envelope of the rear portion of the backplane that uniquely corresponds to the first signal path configuration, and wherein the RTM alignment and keying mechanism and the corresponding RTM alignment and keying mechanism interconnect only when the RTM alignment and keying mechanism and the corresponding RTM alignment and keying mechanism both correspond to the first signal path configuration.

10. The VXS multi-service platform system chassis of claim 9, wherein the connector and the corresponding connector interconnect only when the RTM alignment and keying mechanism and the corresponding RTM alignment and keying mechanism both correspond to the first signal path configuration.

11. The VXS multi-service platform system chassis of claim 9, wherein the first signal path configuration comprises a set of active signal paths from the rear transition module to one of a corresponding payload module a corresponding switch module coupled to the front portion of the backplane.

12. The VXS multi-service platform system chassis of claim 9, wherein the first signal path configuration comprises a set of active signal paths in the corresponding connector that communicatively couple the corresponding connector in the rear portion of the backplane to a payload connector in a third mechanical envelope of a front portion of the backplane, wherein the corresponding connector is substantially coplanar with the payload connector.

13. The VXS multi-service platform system chassis of claim 9, wherein the RTM alignment and keying mechanism comprises an alignment portion uniquely corresponding to a first physical type of connector and a coding key portion uniquely corresponding to the first signal path configuration, and wherein the corresponding RTM alignment and keying mechanism comprises a corresponding alignment portion uniquely corresponding to the first physical type of connector and a corresponding coding key portion uniquely corresponding to the first signal path configuration.

14. The VXS multi-service platform system chassis of claim 13, wherein the connector and the corresponding connector interconnect only when:

the alignment portion and the corresponding alignment portion both correspond to the first physical type of connector; and the coding key portion and the corresponding coding key portion both correspond to the first signal path configuration.

* * * * *